US009222336B2

(12) United States Patent
Winn et al.

(10) Patent No.: US 9,222,336 B2
(45) **Date of Patent: *Dec. 29, 2015**

(54) DEVICES, SYSTEMS AND METHODS RELATING TO DOWN HOLE OPERATIONS

(71) Applicant: Well Grounded Energy, LLC, Casper, WY (US)

(72) Inventors: Dave Winn, Casper, WY (US); Elvis E. Dean, Casper, WY (US)

(73) Assignee: Well Grounded Energy, LLC, Casper, WY (US)

( * ) Notice: Subject to any disclaimer, the term of this patent is extended or adjusted under 35 U.S.C. 154(b) by 47 days.

This patent is subject to a terminal disclaimer.

(21) Appl. No.: 13/746,282

(22) Filed: Jan. 21, 2013

(65) Prior Publication Data

US 2013/0192818 A1 Aug. 1, 2013

Related U.S. Application Data

(63) Continuation-in-part of application No. 12/423,802, filed on Apr. 14, 2009, now Pat. No. 8,356,662.

(51) Int. Cl.
*E21B 37/02* (2006.01)

(52) U.S. Cl.
CPC ..... *E21B 37/02* (2013.01)

(58) Field of Classification Search
USPC ..... 166/311, 312, 170, 171, 173, 174
See application file for complete search history.

(56) References Cited

U.S. PATENT DOCUMENTS 6,343,648 B1 * 2/2002 Carmichael et al. ..... 166/173
8,356,662 B2 * 1/2013 Winn ..... 166/173

* cited by examiner

*Primary Examiner* — William P Neuder
(74) *Attorney, Agent, or Firm* — Jones IP Group

(57) ABSTRACT

Systems and method for improving down hole operations of well casings are disclosed herein. Systems and methods disclosed herein can comprise brushes, high pressure fluid outlets, and skids. Other systems and methods are disclosed herein.

17 Claims, 16 Drawing Sheets

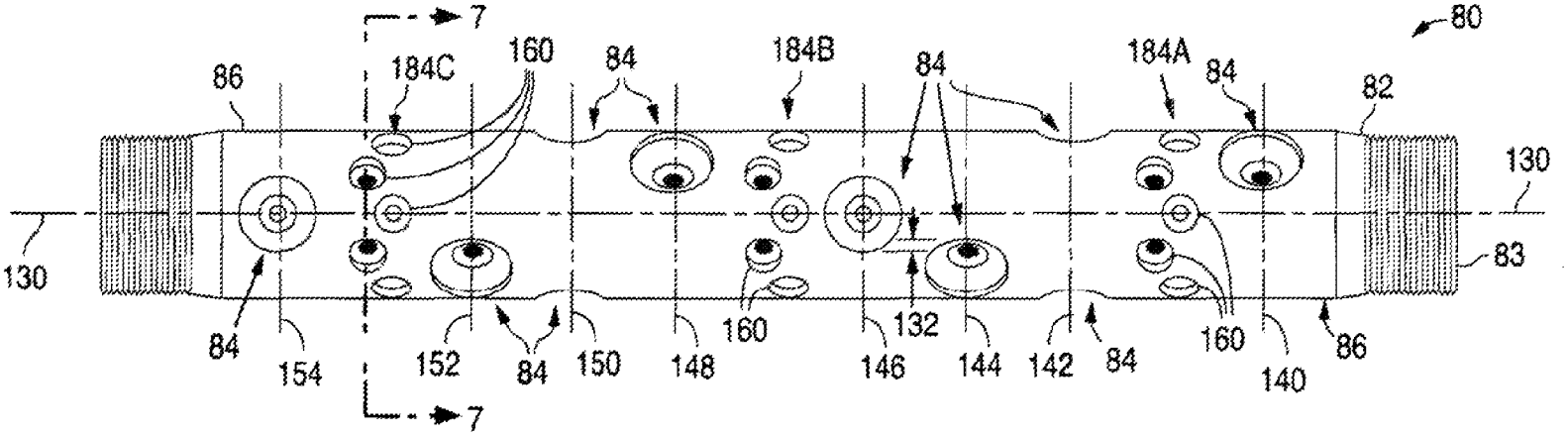
FIG. 4
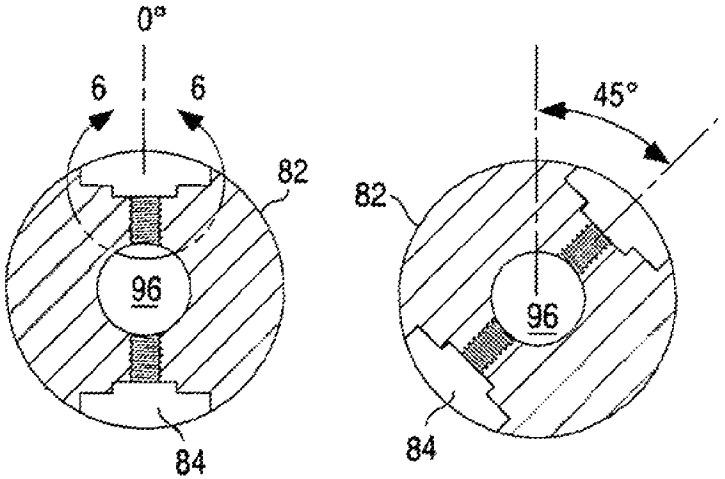
FIG. 5A
FIG. 5B
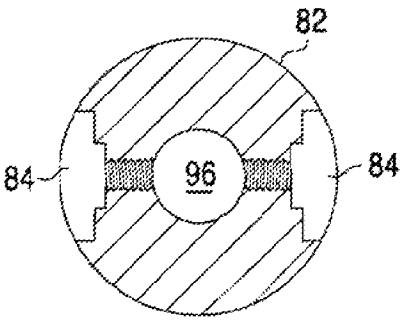
FIG. 5C
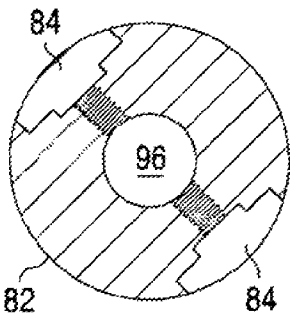
FIG. 5D

DEVICES, SYSTEMS AND METHODS RELATING TO DOWN HOLE OPERATIONS

RELATED APPLICATION(S)

The present application is a continuation-in-part of U.S. patent application Ser. No. 12/423,802, filed Apr. 14, 2009, entitled "DEVICES, SYSTEMS AND METHODS RELATING TO DOWN HOLE OPERATIONS," which claims the benefit of U.S. Provisional Application No. 61/044,675, filed Apr. 14, 2008, and U.S. Provisional Application No. 61/044,667, filed Apr. 14, 2008, all of which are incorporated herein by reference in their entireties.

FIELD OF THE INVENTION

This invention relates generally to devices, systems and methods relating to improved down hole operations and, more particularly, to devices, systems and methods for enhance the recovery of hydrocarbon liquids and gases from down hole environments.

BACKGROUND OF THE INVENTION

The amount of oil and/or gas that a well produces often reduces significantly over time. The reduction is often caused by clogged or obstructed perforations in the well casing at the production area and the accumulation of wax, scale, or other residue on the inside of the casing of the well. Prior art methods for removing such debris and clearing the well casing perforations often require multiple tools, are inefficient and time consuming. Prior art methods and devices also may tend to alter ground formation permeability and may not allow for immediate bore cleanup without damage to the ground formation. Accordingly, there is a need for a method, system and device that provides for an efficient, cost-effective means to improve down hole operations.

SUMMARY OF THE INVENTION

Certain embodiments of the present invention generally relate to devices, systems and methods relating to improved down hole operations. Embodiments of the present invention may be used to enhance the recovery of hydrocarbon liquids and gases from down hole environments. Embodiments may comprise an assembly attachable to a work string, with the assembly further comprising a plurality of directed fluid jets, brushes and or scrapers. Embodiments may comprise methods of using the assembly to enhance down hole operations or production.

In aspects of the present invention, a device for improving pumping operations through a casing or lining comprises a hollow tube including a tube wall having an outer circumferential surface and an inner circumferential surface, the inner circumferential surface defining a fluid passageway. The device further includes brushes on the outer circumferential surface, and outlet holes formed through the tube wall.

In aspects of the present invention, a system for improving pumping operations through a well casing or lining comprises a hollow scratcher tube including a tube wall having an outer circumferential surface and an inner circumferential surface, the inner circumferential surface defining a fluid passageway having a fluid inlet at one end of the scratcher tube. The system further comprises a plurality of bristles on the outer circumferential surface, a plurality fluid outlets formed through the tube wall, and a filter coupled to the fluid inlet.

In aspects of the present invention, a method for improving down hole operations includes inserting a scratcher tube into a curved casing string, the hollow scratcher including a tube wall having an outer circumferential surface carrying a plurality of brushes and a plurality of nozzles. The method further includes retracting at least one of the plurality of brushes or at least one of the plurality of nozzles to facilitate passage of the scratcher tube past a curved segment of the casing string.

The features and advantages of the invention will be more readily understood from the following detailed description which should be read in conjunction with the accompanying drawings.

BRIEF DESCRIPTION OF THE DRAWINGS

FIG. 4 is a side view of an assembly for improving down hole operations, showing a plurality of outlet holes and inset portions for securing nozzles and brushes.

FIGS. 5A-5D are cross sectional views of the assembly of FIG. 4, showing various angular positions of inset portions for securing brushes.

DETAILED DESCRIPTION

Some embodiments of the present invention may comprise an assembly having a generally tubular shape and having a diameter appropriately sized to be inserted into the casing or well lining of a well, including in some instances an oil or gas production well. In some embodiments of the present invention the assembly may further comprise pressure jets, nozzles, and or orifices, brushes, and or scrapers. The assembly may comprise attachment configurations on an upper and lower portion of the assembly. The attachment configurations may facilitate attachment of the upper end of the assembly to a work string, sucker or other assembly. The attachment configurations may also facilitate attachment of the lower end of the assembly to other devices such as scrapers, filters, baskets or other devices.

In some embodiments the present invention is used to improve the flow of fluids, such as petrochemicals, or gases, through perforations or holes in the casing of an oil or gas well. In some embodiments of the present invention the flow of fluids or gases through the formations adjacent the perforations or holes in the casing may also be improved.

Over the course of production of fluids or gases from a well there may typically be a buildup of paraffin, wax, scale, or other residue on the inside of the casing of the well. In some instances the perforations or other slots or openings on the casing become clogged to some degree. Additionally spaces in the geological formations adjacent the casing may also become clogged to some degree. Each of these conditions may tend to inhibit the flow of desired gases or fluids from the geological formation through the slots or perforations and into the casing of the well where it can be extracted from the well. Aspects of the present invention are particularly useful in cleaning the inside environment of the casing, of opening the perforations or slots extending through the casing and further, in opening portions of the geological formations adjacent the casing to further facilitate the flow of gases or liquids.

Figure 1:
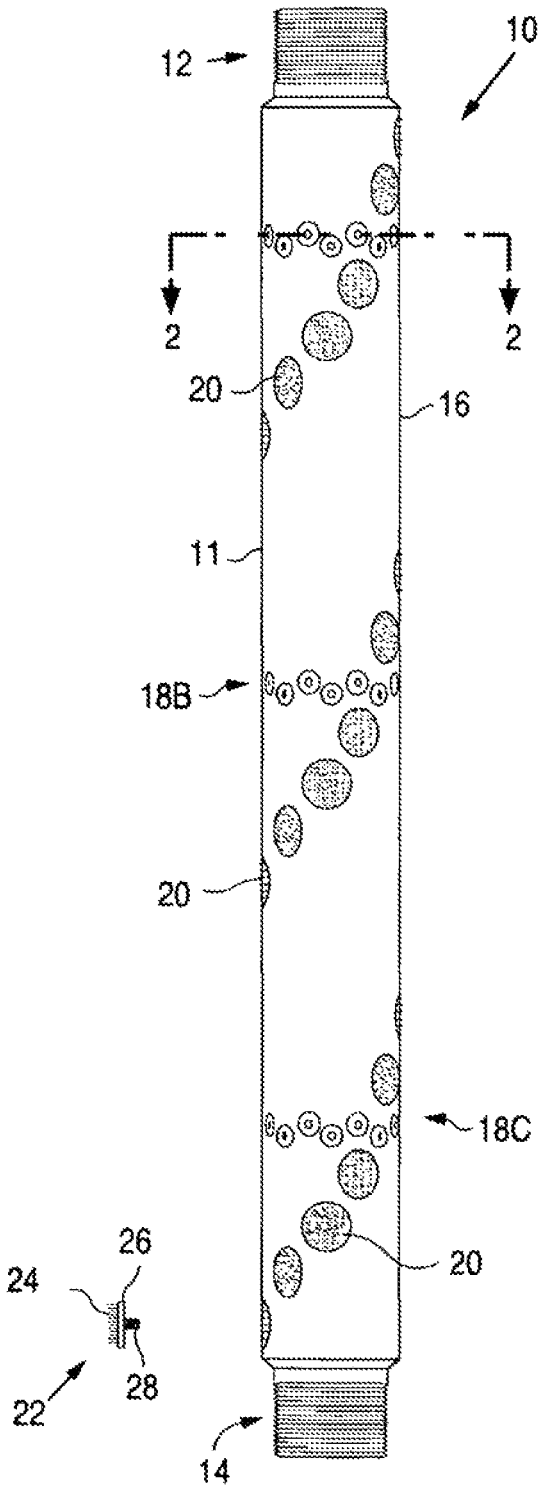
FIG. 1 is a side elevation view of an assembly for improving down hole operations, showing a main body having a plurality of nozzle assemblies and brush assemblies.

FIG. 1 shows an embodiment of the present invention. Shown is an assembly 10 having an upper threaded portion 12 and a lower threaded portion 14. Further shown in the assembly of FIG. 1 are three rings of nozzles (or high-pressure jets) 18 (shown at 18A, 18B and 18C). Also shown in FIG. 1 is a spiraling array of brush assemblies 20. An individual brush assembly is shown at 22 having brush fibers 24, fiber assembly holder 26, and threaded portion 28.

The assembly 10 may comprise a pipe like main body 11 having an outer diameter and an inner diameter.

Main body 11 may have an inset portion for receiving the fiber assembly holder 26 of the individual brush assembly 22. Further the inset portion they also comprise a receiver for receiving the threaded portion 28 of the brush assembly 22. In some embodiments, the fiber assembly holder 26 does not extend out past the general exterior wall of the main body 11. Instead, the brush fibers 24 extend radially out past the general exterior wall of the main body in 11. The inset portions for receiving the fiber assembly, in some embodiments, may be spiraled vertically about the main body 11 as shown in FIG. 1. Such an arrangement allows for the overlap of the individual brushes of the brush assemblies 22 with the brushes of adjacent assemblies.

Figure 2A:
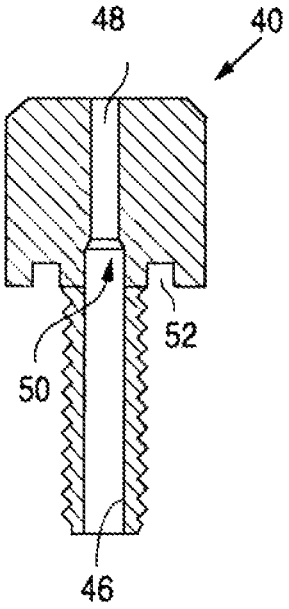
FIG. 2A is a cross sectional view of a nozzle assembly.
Figure 2B:
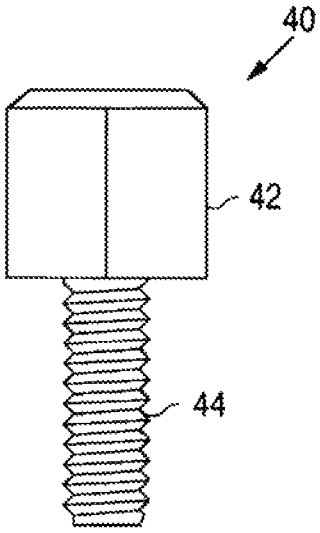
FIG. 2B is a side elevation view of the nozzle assembly of FIG. 2A.
Figure 3:
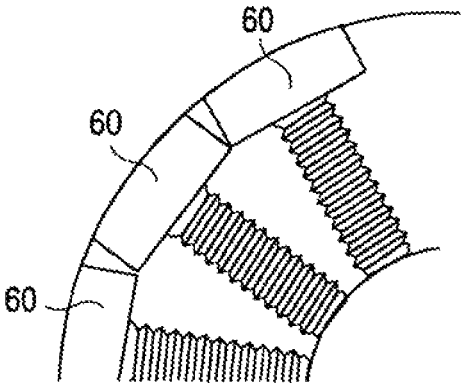
FIG. 3 is a cross sectional view of a portion the main body of FIG. 1, showing staggered insets 60 for receiving the nozzle assembly of FIGS. 2A and 2B.

Main body 11 may also include inset portions for receiving individual nozzles or high-pressure jets indicated at 18 and further illustrated in FIGS. 2 and 3. In some embodiments the inset portions for the individual nozzles are distributed around the circumference of the main body 11 as shown at 18. In some embodiments the distribution of the inset portions for the nozzles may be staggered vertically as shown in FIG. 1 at 18. This staggering of the inset portions provides several advantages. One advantage is that it allows the nozzles to be spaced circumferentially about the main body 11 with smaller angles separating a first nozzle from an adjacent nozzle while still providing high structural integrity and strength to the main body 11. In addition, as shown at FIG. 3, the individual insets may be so closely spaced that, as shown in FIG. 3, when viewed in cross-section the insets may appear to overlap with each other. By staggering the insets, this small rotational angle between the direction of adjacent nozzles can be achieved without deleteriously diminishing the structural integrity of the main body 11.

In some embodiments the assembly 10 is connected by upper threaded portion 12 to a working string and lowered to the production zone of a well. The assembly 10 can be raised and lowered by the working string to effect a beneficial interaction between the inside of the casing of the well and the brush assemblies 20 of the assembly 10. The brush assemblies can be configured in some embodiments to provide forceful brush contact simultaneously around the interior circumference of the casing as the assembly 10 is raised and lowered through the production zone of the casing. The brush assemblies 20, then, "scrub" the interior portions of the casing in the production zone. Such scrubbing is useful in removing undesirable materials from the inside of the casing and the perforations or slots in the casing.

In some embodiments, simultaneously with the raising and lowering of the assembly 10 through the production zone of the well, high-pressure fluids are pumped through the work string into the top portion of the assembly 10. In some embodiments, the assembly 10 will have a cap or similar structure attached to the bottom threads 14 prohibiting the exit of high-pressure fluids through the bottom portion of the assembly 10. The high-pressure fluid will then exit the individual nozzles 18 of the assembly producing a highly desirable scouring effect on the interior portions of the casing as well as in the perforations and slots of the casing. The high-pressure flows of the fluid can also extend into the geological formations adjacent the casing thus opening improved opportunities for the flow of gas or fluid through the geological formations.

Because of the overlap of the brush assemblies 20 when the assembly 10 is raised and lowered through the casing, the entire periphery of the casing is scrubbed by the brushes. The assembly 10 can include a number of brushes including one to four (or more) sets the brushes covering 360° of the exterior of the assembly 10.

Shown in FIG. 1 are three arrays of nozzles, 18A, 18B and 18C, in some embodiments a greater or lesser number of arrays of nozzles can also be used.

FIG. 2 shows two views of an exemplary nozzle assembly 40. FIG. 2B shows a plain view of the nozzle assembly 40 having a hexagonal or orthogonal head portion 42 and a threaded portion 44. FIG. 2A shows a cutaway view of the nozzle assembly 40 of FIG. 2B.

Shown in FIG. 2A is a fluid passageway comprising three sections: large diameter section 46, step down section 50, and small diameter section 48. Also shown is an O-ring receiver portion 52. The nozzle assembly 40 can be assembled into an appropriately sized inset in the main body 11. The threaded portion 44 will mate with a threaded receiver in the main body 11. The main body inset for the nozzle 40 can also comprise a receiver surface for receiving the O-ring (not shown) to be an attached in O-ring receiver portion 52. The small diameter section 48 of the fluid passageway can be of varying lengths, including significantly shorter than the large diameter portion 46. With this configuration the flow of high-pressure fluids through the nozzle assembly 40 is significantly facilitated, allowing a greater flow of fluid through the nozzle assembly 40 and reducing the energy loss of forcing the fluid through the fluid passageway of the nozzle assembly 40.

Shown that FIG. 3 is a partial cross-sectional view of the main body 11 along the line 2-2 of FIG. 1. Shown in FIG. 3 are three staggered insets 60 for receiving the nozzle assembly 40. As can be seen in FIG. 3, the insets 60 may actually be positioned on radial angles sufficiently small that in the perspective of FIG. 3 the insets 60 may be seen to overlap with each other. This facilitates a very close spacing of the angles of fluid jets from the nozzle assemblies 40 and increases the likelihood that high-pressure jet fluid flow will be directed at virtually every portion of the interior surface, perforation, slot or other opening of the casing. Further, the individual insets 60 can be "clocked" respectively between the arrays of nozzles such as is shown in 18A, 18B and 18C. Thus the individual nozzles of 18B can be clocked a few degrees from the positioning of the nozzles of 18A and the nozzles of 18C can be clocked a few degrees from the positioning of the nozzles of 18B. In this fashion a very comprehensive coverage of the interior surfaces of the casing, perforations, slots or other openings can be achieved by the directed jets of fluids exiting the nozzles.

During operation, in some embodiments, the main body 11 can be raised and lowered once or multiple times through the entire production zone of the well. In such fashion, the individual brushes and nozzles are effective through the entire production zone.

In some embodiments a tubular type filter can be positioned at the top of the assembly 10 and inside the work string attached to the assembly 10. The filter can provide many benefits including ensuring that only desired qualities of fluids (i.e. fluids without undesirable particles) are pumped into the assembly 10 and out the individual nozzles 40. The tubular configuration of the filter can facilitate a modular array of filters that are connected end to end above the assembly 10. In this fashion an overabundance of filter modules can be provided in conjunction with the assembly 10 before it is lowered into the well. The overabundance of filter capability can be useful to prevent a circumstance where a deficiency in filter surface area might exist while the tool 10 is down in the casing in cleaning operation. Should the filter have insufficient surface area to handle filtering needs for the entire duration of the cleaning operation, the filter may collapse because of the high pressures or otherwise become clogged thus reducing the efficacy of the cleaning operation. In some embodiments, the filter assemblies may comprise a 40 micron stainless steel strainer positioned at some distance, such as 30 feet, above the assembly 10 and a 30 micron stainless steel strainer located directly over the assembly 10.

In some embodiments, the inset portion for receiving the fiber assembly holder 26 of the individual brush assemblies 22 may be designed to snugly receive the fiber assembly holder 26. By this fashion additional mechanical support and directive force is applied to the brush portions of the individual brushes.

In some embodiments the assembly 10 can be configured and the system operated so as to provide up to 2000 or more pounds of fluid pressure per individual nozzle.

Some embodiments of the present systems and devices can be applied to improve production from liner completed wells, inner liner completed wells, and solid string completed wells.

In some embodiments a surface pump is used to displace fluids at high pressures through a working string to the assembly 10. In some embodiments the assembly 10 may also comprise an upper collar that acts as a centralizer for the apparatus while in the casing. In some embodiments the assembly 10 may comprise a lower collar that acts as a centralizer for the apparatus while in the casing. In some embodiments the apparatus 10 may include both an upper and a lower collar. In some embodiments a scraper may be attached to the lower portion of the assembly 10. The collars may also allow the washing fluid to be evenly displaced.

In some embodiments the O-ring used in the nozzle assembly seating system may comprise Viton. In some embodiments the hexagonal or octagonal portion of the nozzle assembly 40 may facilitate set torque specifications for attaching the nozzle assemblies to the main body 11 and prohibiting undesirable loosening of the nozzles or over tightening of the nozzles. In some embodiments two or more circumferences of brush assemblies may be provided on the main body 11.

In some embodiments the fluid pumped through the assembly 12 may comprise an acidic solution. In some embodiments the fluid may comprise a washing fluid. In some embodiments the fluid may comprise water as found in the region of the well site.

In some embodiments the individual nozzle assemblies 40 may extend radially outside the surface of the main body 11. In some embodiments the individual nozzles assemblies 40 may extend just to the exterior surface of the main body 11. In some embodiments the individual nozzle assemblies may not extend out to the exterior surface of the main body 11. In some embodiments the nozzle assemblies 40 may be movably mounted on the main body 11. In one embodiment, the nozzle assemblies are seeded into receivers in the main body. The nozzle assembly is connected to a piston type seat which is positioned in an inset in the main body. During operation when the assembly 10 is positioned in the production zone of the casing and the high-pressure fluid pumping is initiated, the pressure from the high-pressure fluid presses the piston assembly radially outward pressing the nozzles also radially outward and closer to the inside surface of the casing. In some embodiments the brush assemblies may also be movably positioned with piston type assemblies attached to the individual brushes. Again, when high-pressure fluid pumping is initiated the fluid pressure presses the piston assemblies and presses the brush assemblies radially outward and in enhanced contact with the inner surface of the casing. In some embodiments, the nozzle and or brush assembly configuration may include a spring which biases the positioning of the nozzle and or the individual brushes radially inward in the assembly 10 and until high-pressure fluid pumping is initiated. With the initiation of the high-pressure pumping, the bias of the spring is overcome by the pressure of the fluid on the piston and the nozzle and or brush is pressed radially outward into an enhanced position vis-à-vis the interior surface of the casing. In some embodiments this movable configuration of brush assemblies prevents the premature engagement of the brush with the inner surface of the casing as the assembly 10 is lowered through the well casing to the production zone. In some embodiments lowering the assembly 10 with the brushes fully engaged on the inner surface of the casing down the length of the casing can serve to both press undesirable amounts of debris or other materials into the production zone of the well (from upper portions of the well) and or undesirably wear out or bend the individual fibers of the brushes before the tool is actually positioned in the production zone of the well. In such an instance the scouring action of the brushes is diminished before the brushes reach the production zone of the well.

Figure 6:
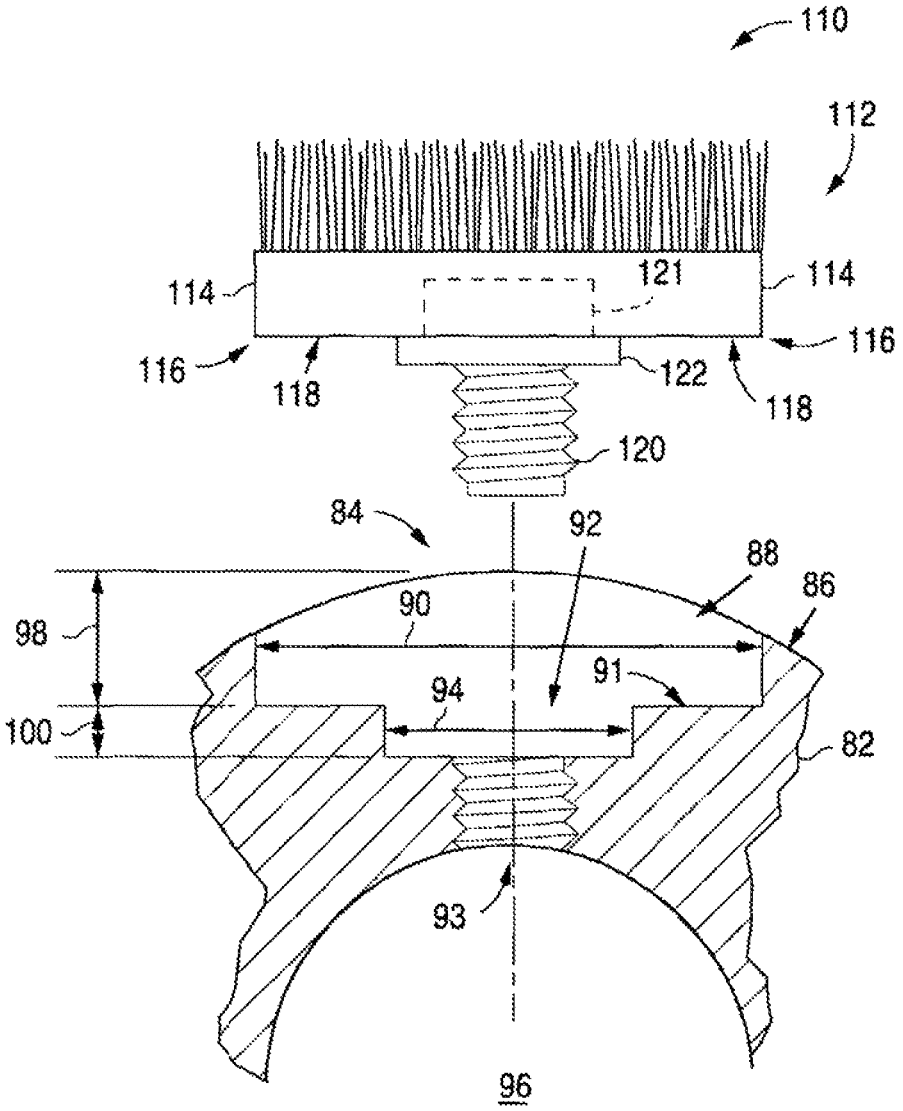
FIG. 6 is a cross sectional detailed view of a portion of FIG. 5A, showing an inset portion and a correspondingly shaped brush assembly adapted to be secured into the inset portion.

As previously mentioned, the main body 11 may have an inset portion for receiving the fiber assembly holder 26 of the individual brush assembly 22. FIG. 4 shows a side view of an assembly 80 in accordance with embodiments of the present invention and FIGS. 5A-5D and 6 show cross-sectional views of the assembly 80. As shown in FIG. 6, which is a detailed view of a portion of FIG. 5A, a main body in the form of a hollow tube 82 has a recess or inset portion 84 that is formed into the outer circumferential surface 86 of the hollow tube. The inset portion 84 includes a first counter bore 88 having a first diameter 90. The bottom surface 91 at the base of the first counter bore 88 provides a flat contact surface area that frictionally engages a brush assembly 110. A holder portion 112 of the brush assembly 110 includes outer walls 114 that radius or bend inward at a radiused portion 116. The radiused portion 116 surrounds a planar or flat portion 118. When assembled, the flat portion 118 is pressed tightly against the bottom surface 91 at the base of the first counter bore 88.

At the base of the first counter bore 88, there is a second counter bore 92 that extends further toward the center of the tube 82. The second counter bore 92 has a second diameter 94 that is smaller than first diameter 90 of the first counter bore 88. At the base of the first counter bore 92, there is a threaded through hole 93 that extends to the hollow portion 96 at the center of the tube 82. The first counter bore 88, second counter bore 82, and threaded hole 93 are concentric with each other. The threaded hole is adapted to receive an externally threaded portion 120 of the brush assembly 110. A circular boss 122 is located at the interface between the flat portion 118 and the threaded portion 120 of the brush assembly 110.

In some embodiments, the threaded portion 120 is the body of a screw or bolt that is removable from the holder portion 112 of the brush assembly 110. As explained below, a removable bolt would allow the brush assembly 110 to be easily mounted at preselected torque and removed for replacement due to wear. The threaded body of the removable bolt extends through a bore formed through the flat portion 118 and the boss 122. During assembly, the holder portion 112 may be seated into the inset portion 84 of the tube 82 without the bolt. The boss 122, being fixedly secured to the flat portion 118, provides a piloting function when fitting within the second counter bore 92. The piloting function centers or aligns the bore in holder portion 112 with the threaded through hole 93 in the tube 82. In this manner, the removable threaded body 120 of the bolt can be inserted through the bore and into the threaded hole 93. The head 121 of the bolt is held on the other side of the flat portion 118 and is tightened to a preselected torque level to ensure sufficient fictional contact between the flat portion 118 and bottom surface 91 of the first counter bore 88. The area of the brush assembly 110 which surrounds the head 121 of the bolt may be free of bristles to allow access to the head 121 for tightening and removal of the bolt.

In some embodiments, the removable bolt is a 5/16"-18 hex head bolt and the threaded hole 93 is tapped to receive the 5/16"-18 thread of the bolt. Applicant has found that a 5/16" diameter for the threaded portion 120 provides sufficient combination of strength that prevents the brush assembly 110 from being sheared or broken off the tube 82 during cleaning operations in a well casing and sufficient thread engagement to prevent loosening.

In some embodiments, the first counter bore 88 has a depth 98 from the outer surface 86 that is at or about 0.375 inches, and the first diameter is at or about 1.375 inches. The depth 98 may be carefully selected so that bristles of a brush assembly extend radially outward beyond the outer surface 86 of the hollow tube 82 so as to make the overall outer diameter of the assembly 80, measured from the tips of the bristles, greater than an inner diameter of the well casing or lining that is to be cleaned. In some embodiments, the bristles are of varying height and the overall outer diameter is measured from bristle tips that account for about 85% to 95% of the bristles. In some embodiments, the overall diameter as measured from 85% to 95% of the bristle tips is about 0.1 inches greater than the inner diameter (I.D.) of the casing to be cleaned. Applicant has found that having the overall diameter of the assembly 80 being 0.1 inch oversized relative to the well casing I.D. provides optimal cleaning results in many cases. In some embodiments, where the I.D. of the casing to be cleaned is about 5.5 inches, the overall diameter of the assembly 80 as measured from 85% to 95% of the bristle tips is at or about 5.6 inches. It will be appreciated that over sizing to a greater or lesser amount may be implemented as desired depending on the application, such as type of well, ground conditions, and other factors.

In some embodiments, the second counter bore 92 has a depth 100 from the base of the first counter bore 88 that is at or about 0.15 inches. In some embodiments, the depth 100 may be selected so that the boss 122 on the holder portion 112 of the brush assembly 110 does not bottom out or make contact with the bottom surface at the base of the second counter bore 92. That is, the depth 100 is selected to allow for a small gap to remain between boss 122 and the bottom surface of the second counter bore 92. In this manner, as the threaded portion 120 is tightened into the threaded hole 93, the flat surface 118 of the brush assembly 110 is free to press down completely and engage the bottom surface 91 of the first counter bore 88 so as to prevent the brush assembly 110 from rotating and becoming dislodged during cleaning operations in the well casing.

In some embodiments, as shown in FIG. 4, the inset portions 84 are spaced axially apart along the length of the tube 82. In the illustrated embodiment, the tube 82 includes sixteen inset portions 84 in which are mounted a corresponding number of brush assemblies 110. At each axial position, there are two inset portions 84 facing at opposite directions. The two opposite facing inset portions 84 lie on the same plane that is oriented perpendicular or substantially perpendicular to the central axis 130 of the tube 82. In the illustrated embodiment, there are a total of eight such planes each having two opposite facing inset portions 84. FIGS. 5A-5D show the cross-section at four of those planes.

As shown in FIGS. 4 and 5A-5D, the pairs of inset portions 84 are oriented at various angular positions in a double helical pattern. Each pair of inset portions 84 is clocked or angularly offset by forty-five degrees from adjacent pairs of inset portions 84. In FIG. 5A, with the 12 o'clock position designated at 0 degrees, the two inset portions 84 at plane 142 (FIG. 4) may be described as being located at a 0-degree and a 180-degree position. In FIG. 5B, the two inset portions 84 at plane 144 (FIG. 4) may be described as being located a 45-degree position and a 225-degree position. In FIG. 5C, the two inset portions 84 at plane 146 (FIG. 4) maybe described as being located at a 90-degree position and a 270-degree position. In FIG. 5D, the two inset portions 84 at plane 148 (FIG. 4) may be described as being located at a 135-degree position and a 315-degree position. Thus it will be appreciated that every adjacent grouping of eight inset portions 84 encompasses a 360-degree cleaning coverage of a well casing in which an inset portion is located every 45 degrees. As shown in FIG. 4, the inset portions 84 overlap each other in the circumferential direction, as indicated for example by area 132, thus providing for complete 360-degree cleaning coverage when brush assemblies 110 are mounted in each inset portion 84.

Applicant has found that with a well casing having an inside diameter of about 5 inches, optimal cleaning can be achieved with eight 1.4-inch diameter brush assemblies for every 360 degrees of cleaning coverage. In the illustrated embodiment of FIG. 4, there would be sixteen brush assemblies 110 installed, providing 720 degrees of cleaning coverage. That is, there are sixteen brush assemblies for an internal well casing circumference of seventeen inches, or about one brush for every 1.1 inches of internal circumference of a well casing. Thus, it will be appreciated that a greater or less number of inset portions 84 and corresponding brush assemblies 110 may be implemented to allow for 360-degree cleaning coverage, depending on the internal circumference of the well casing to be cleaned. In other embodiments, there is one brush assembly for every 1.2 to 2 inches of well casing internal circumference. In other embodiments, there is one brush assembly for every 0.5 to 1 inches of well casing internal circumference.

Referring again to FIG. 4, the planes on which the pairs of inset portions 84 are located are axially spaced apart. As previously mentioned, the planes are oriented perpendicular or substantially perpendicular to the central axis 130 of the tube 82. In some embodiments, the axial spacing between the planes is selected to prevent removed material, such as paraffin, wax, scale, or other residue on the inside of the casing of the well, from building up and gathering around the bristles of the brush assemblies 110 to an extent inhibits cleaning. In some embodiments, the axial spacing provides a helical or spiral channel between the brush assemblies 110 to allow the removed material and cleaning fluid to move away from the assembly 80 while in the well casing, thereby allowing for continuous high pressure flow of cleaning fluid.

In some embodiments, a first plane 140 is located at an axial distance of about 3.38 inches from a first edge 83 of the tube 82. The previously mentioned second plane 142 is located at an axial distance of about 6.44 inches from the first edge 83. FIG. 5A shows the cross-sectional view through the second plane 142. The previously mentioned third plane 144 is located at an axial distance of about 8.14 inches from the first edge 83. FIG. 5B shows the cross-sectional view through the third plane 144. The previously mentioned fourth plane 146 is located at an axial distance of about 9.84 inches from the first edge 83. FIG. 5C shows the cross-sectional view through the fourth plane 146. The previously mentioned fifth plane 148 is located at an axial distance of about 12.9 inches from the first edge 83. FIG. 5D shows the cross-sectional view through the fifth plane 148. A sixth plane 150 is located at an axial distance of about 14.6 inches from the first edge 83. A seventh plane 152 is located at an axial distance of about 16.3 inches from the first edge 83. An eighth plane 154 is located at an axial distance of about 19.4 inches from the first edge 83.

Still referring to FIG. 4, the tube 82 includes a plurality of holes 160 which provide outlets for cleaning fluid flowing through the central passage 96 of the tube 82. The outlet holes 160 are arranged in series along several circumferential ring patterns on the outer surface 86 of the tube 82. Each circumferential pattern or ring lies on an outlet plane oriented perpendicular or substantially perpendicular to the central axis 130 of the tube 82.

Figure 7:
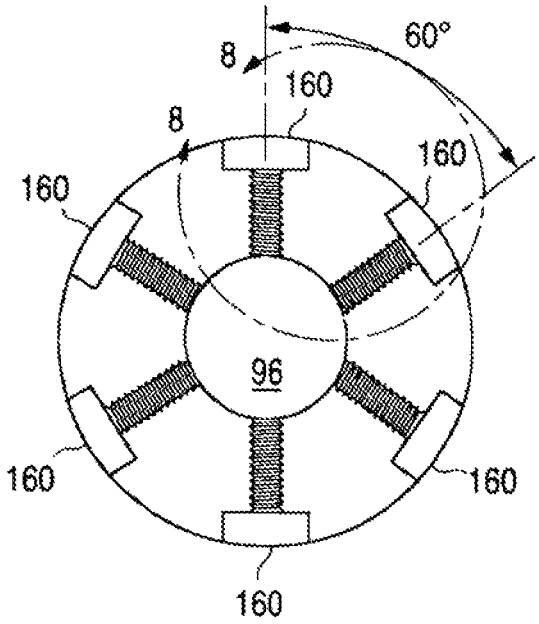
FIG. 7 is a cross sectional view of the assembly of FIG. 4, showing various angular positions of outlet holes for securing nozzles.

In the illustrated embodiment of FIG. 4, the outlet holes 160 are concentrated in three jetting zones 184A, B, C, each of the zones comprising twelve outlet holes 160. The twelve outlet holes 160 are centered on a pair of outlet planes that oriented perpendicular or substantially perpendicular to the central axis 130 of the tube 82. One of these outlet planes is designated as line 7-7 in FIG. 4 and a cross-sectional view at this plane is shown in FIG. 7. Each outlet plane includes six outlet holes 160. The pair of outlet planes are spaced apart axially. The axial spacing between the outlet planes (i.e., the axial spacing between outlet holes 160) may be selected as a balance between, on one hand, maintaining sufficient strength and structural integrity of the tube 82, and on the other hand, maximizing the number of outlet holes 160 to provide cleaning coverage of the well casing circumference. In the illustrated embodiment, the axial spacing between planes of each pair is at or about 0.4 inches. Further, each jetting zone 184A, B, C is axially spaced apart from an adjacent jetting zone. The axial spacing between each jetting zone 184A, B, C may be selected as a balance between, on one hand, maximizing fluid flow out of each jetting zone without inhibiting or significantly affecting fluid flow from an adjacent jetting zone, and on the other hand, minimizing the overall axial length of the assembly 80. In the illustrated embodiment, the first jetting zone 184A is at least about 6 inches from the second jetting zone 184B, which is about 6 inches from the third jetting zone 184C.

Figure 8:
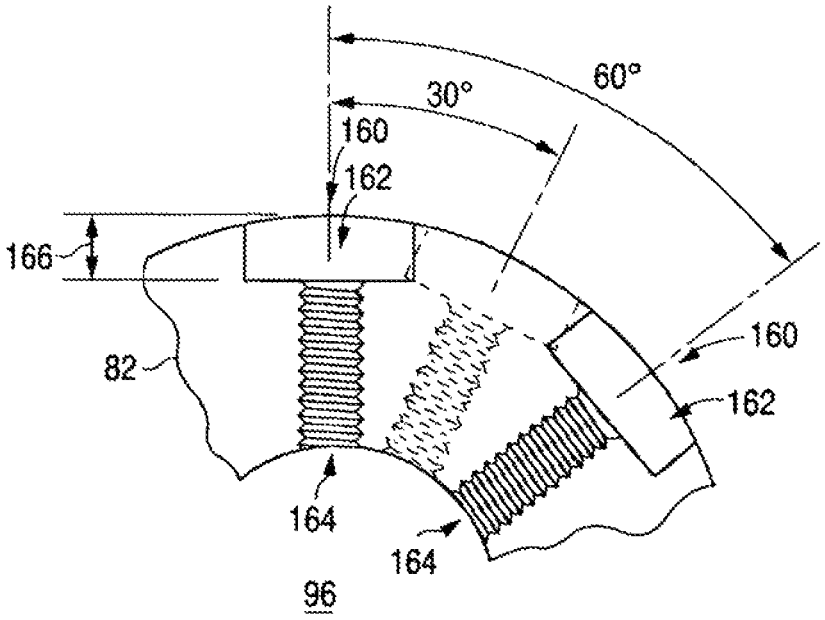
FIG. 8 is a cross-sectional detailed view of a portion of FIG. 7.

As shown in FIG. 7, each outlet plane includes six outlet holes 160. The outlet holes 160 are equally spaced apart from each other by about 30 degrees. For a well casing having an internal diameter of about 5.5 inches, there are six outlet holes 160 distributed around an internal well casing circumference of 17 inches. That is, for each outlet plane, there is one outlet hole for about every 3 inches of internal well casing circumference. As previously mentioned each jetting zone 184A, B, C includes two outlet planes. As shown in FIG. 8, the outlet holes 160 of one outlet plane (illustrated with solid lines) are clocked or offset by 30 degrees from the outlet holes 160 of the immediately adjacent outlet plane (illustrated with broken lines). Thus, each jetting zone, which includes two outlet planes, provides twelve outlet holes 160 distributed around an internal well casing circumference of 17 inches. That is, for each jetting zone 184A, B, C, there is one outlet hole for about every 1.4 inches of internal well casing circumference. It will be appreciated that a greater or less number of outlet holes 160 may be implemented depending on the internal circumference of the well casing to be cleaned. In some embodiments, there is one outlet hole 160 for about every 0.7 to 1.3 inches of internal well casing circumference. In some embodiments, there is one outlet hole 160 for about every 1.5 to 2 inches of internal well casing circumference.

In some embodiments the outlet holes 160 and nozzles 170 in one jetting zone is clocked or offset at a preselected angle from the outlet holes 160 and nozzles 170 of adjacent jetting zones. FIG. 8 shows the angular positions of the outlet holes 160 and nozzles 170 for one of the jetting zones 184C. For the adjacent jetting zone 184B, the angular positions of the outlet holes 160 and nozzles 170 can be clocked or offset by an angle of about 10 degrees from what is shown in FIG. 8. For the third jetting zone 184A, the angular positions of the outlet holes 160 and nozzles 170 can be clocked or offset by an angle of about 20 degrees from what is shown in FIG. 8. In this manner, the entire assembly 80 provides a high pressure jet of cleaning fluid at every 10 degree position. For a well casing having an LD. of 5.5 inches, there would be 36 nozzles 170 for every 17.3 inches of well casing internal circumference. That is, for the entire assembly 80, there is one nozzle for about every 0.5 inches of well casing internal circumference. In some embodiments, the entire assembly 80 provides one nozzle 170 for every 0.1 to 0.4 inches of well casing internal circumference. In some embodiments, the entire assembly 80 provides one nozzle 170 for every 0.6 to 1 inch of well casing internal circumference.

Referring again to FIG. 8, each outlet hole 160 includes a counter bore 162 and an internally threaded hole 164 that extends from the base of the counter bore to the hollow portion or central fluid passageway 96 of the tube 82. The outlet hole 160 is shaped to receive a nozzle 170, shown in FIGS. 9A-D. The counter bore 162 is sized to receive a nozzle outlet portion 172 and the threaded hole 164 is configured to engage an externally threaded portion 174 of the nozzle 170.

In some embodiments, the counter bore 162 has a depth 166 that may be selected such that an outermost tip of the nozzle outlet portion 172 extends radially outward and away from the outer surface 86 of the tube 82 by a distance of about 0.25 inches, leaving a gap of about 0.5 inches between the nozzle tip and the interior surface of a well casing to be cleaned. It will be appreciated that the nozzle tip may protrude outward at lesser or greater distances.

In some embodiments, as shown in FIG. 9A-D, the nozzle 170 has the shape of a hexagon-head bolt with side walls that can be engaged by a torque wrench or other tool to allow for installation and removal of the nozzle for cleaning and replacement. In some embodiments, the nozzle 170 is about one inch in length, with the nozzle outlet portion 172 and the threaded portion 174 being about 0.5 inches each in length. The side walls 176 of the hexagon-shaped outlet portion 172 may have a wall-to-wall distance 178 of about 0.5 inches and a point-to-point distance 180 of about 0.6 inches, which allows rotation of the outlet portion 172 within a 0.625-inch diameter of the counter bore 162 of the outlet holes 160. A fluid passageway 182 formed through the nozzle 170 tapers down in three segments: an inlet segment 184 having a first diameter, an outlet segment 186 having a second diameter smaller than the first diameter, and a constriction or tapered segment 188 disposed between the inlet and outlet segments and providing a transition from the first diameter to the second diameter. The tapering down or narrowing of the fluid passageway 182 facilitates high pressure flow of cleaning fluid out toward the well casing. The second diameter may be selected to maintain a balance between, on one hand, having sufficient clean fluid flow volume and pressure, and on the other hand, maintaining strength and structural integrity of the threaded portion 174 to prevent the nozzle outlet portion 172 from shearing off the tube 82 during cleaning operations inside the well casing. In some embodiments the first diameter is about 5/64 inch and the second diameter is about 1/8 inch and 0.6 inches deep. In some embodiments, the threaded portion 174 has a 1/4"-20 NC thread and the threaded hole 164 (FIG. 8) in the tube 82 is tapped to a corresponding thread configuration.

Figure 9C:
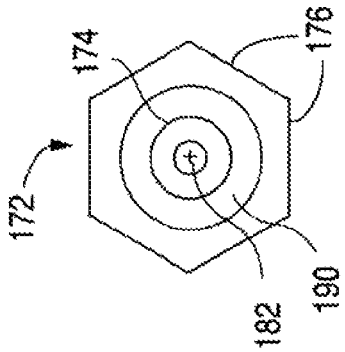
FIGS. 9A-9D show a top view, side view, bottom view, and cross-section view, respectively, of a nozzle.
Figure 9B:
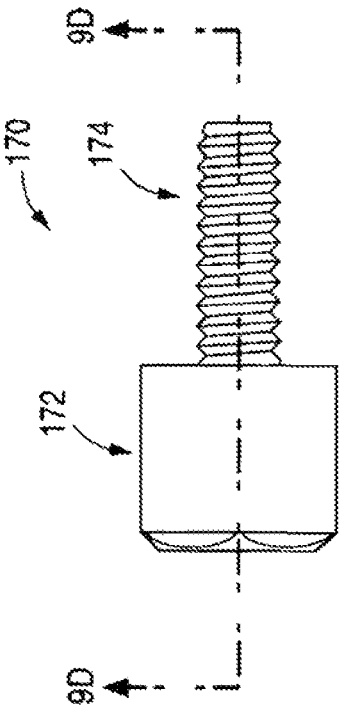
Figure 9D:
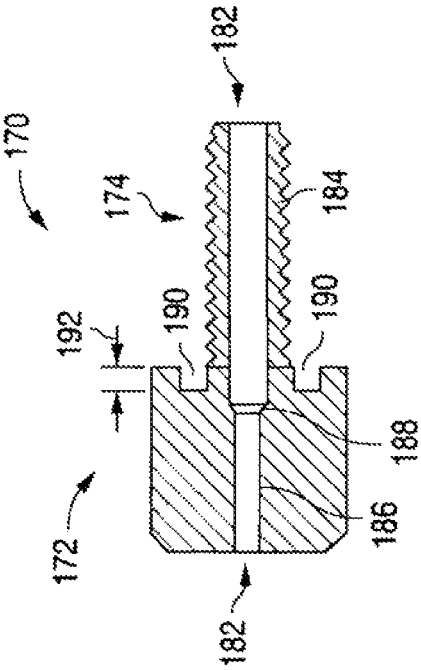
Figure 9A:
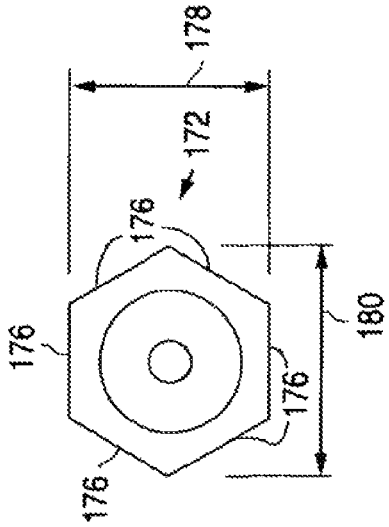

As shown in FIGS. 9C and 9D, the outlet portion 172 of the nozzle 170 includes an annular groove 190 configured to receive a resilient O-ring seal when in an undeformed or natural state. The annular groove 190 may be sized to allow the entire O-ring to fit inside of it. In some embodiments, the depth 192 of the groove may be selected to be less than the thickness of the O-ring, and the inner and outer diameters of the groove may be selected to allow space for the O-ring to radially expand. During installation of the nozzle 170 in one of the outlet holes 160 in the tube 82, the O-ring is placed in the annular groove 190 and a tool is used to engage the side walls 176 of the outlet portion 172 and rotate the nozzle 170 to a preselected torque at which the base of the head portion contacts the bottom of the counter bore 162 (FIG. 8) of the outlet hole 160. At the preselected torque level, the O-ring is squeezed due to the relatively shallow depth 192 of the annular groove 190. As the o-ring is squeezed, it may expand to fill the space within the annular groove 190, thereby creating a fluid tight seal. In some embodiments, the O-ring has a thickness of about 0.07 inches, an inner diameter of about 0.24 inches, and an outer diameter of about 0.38 inches. In some embodiments, the annular groove has a depth 192 of about 0.055 inches, an inner diameter of about 0.25 inches and an outer diameter of about 0.41 inches.

Figure 10A:
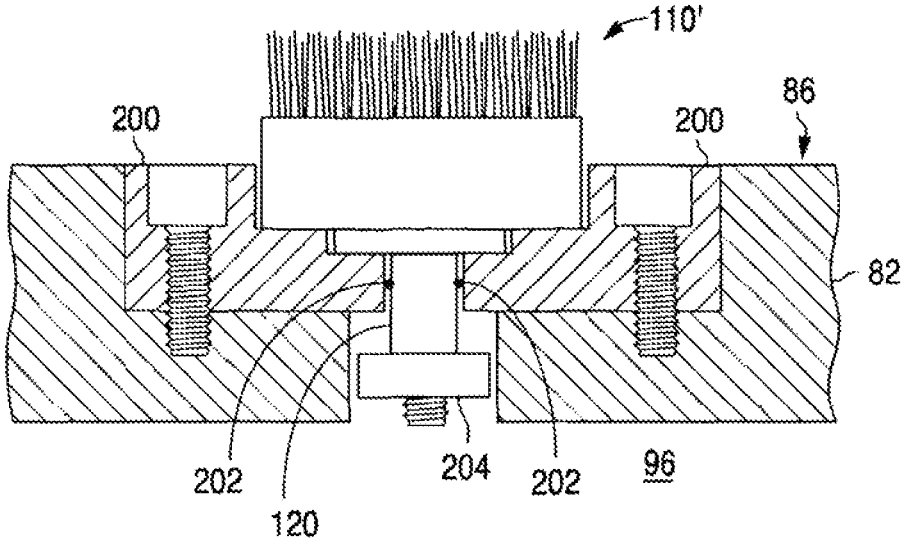
FIGS. 10A-10D are cross-sectional views of piston-type assemblies adapted to allow radial movement of a brush assembly.
Figure 10B:
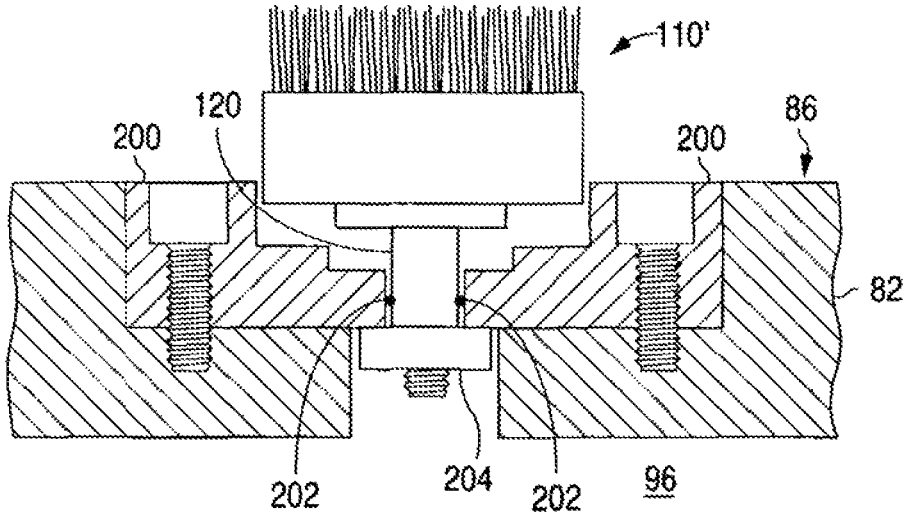
Figure 10C:
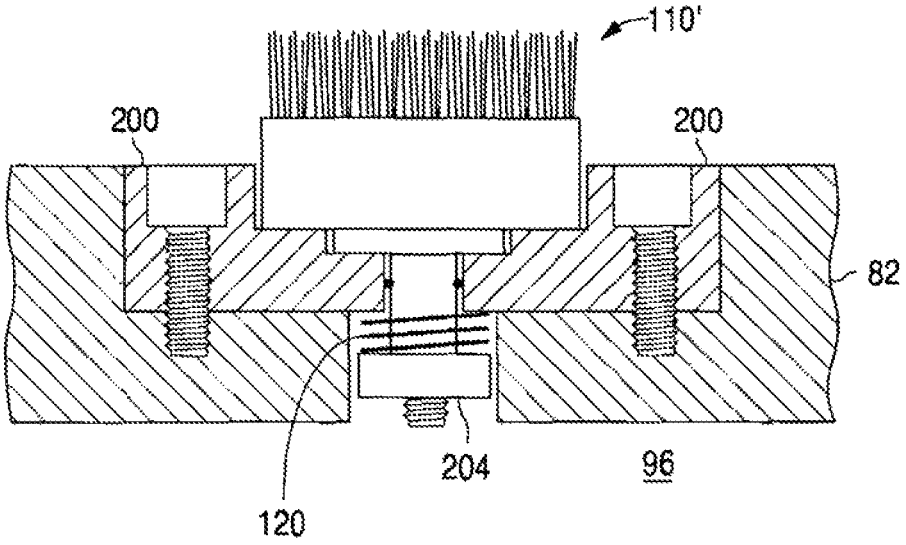

In some embodiments, as shown in FIGS. 10A-I0C, a brush assembly 110' may be retractable or capable of piston-like movement. In operation, while the assembly 80 is being lowered to the desired production area that requires cleaning, the brush assembly 110' is in a retracted position as shown in FIGS. 10A and 10C, thereby avoiding undue wear and degradation of the bristles before the assembly 80 reaches the area to be cleaned, which may be several hundred to thousands of feet below the well surface. When cleaning fluid is introduced into the central fluid passageway 96, pressure from the fluid may force the brush assembly 110' radially outward to an extended position (FIGS. 10B and 10D), away from the center of the tube 82, thereby pressing the bristles of the brush assembly against the inner surface of the well casing to be cleaned.

Retraction may be accomplished using a piston-type assembly that includes inserts 200 that are bolted to the body of the tube 82. Sealing elements 202, such as O-rings, may be used between sliding surfaces of the insert and the stem 120' of the brush assembly 110'. The stem 120' may include a locking element 204 that limits the radially outward movement of the brush assembly.

In other embodiments, as shown in FIG. 10C, the retractable brush assembly 110' may be biased to be in the retracted position by a spring 210 disposed between the locking element 204 and the inserts 200. In this fashion, the brush assembly 110' remains in the retracted position until a threshold level of fluid pressure is present in the central fluid passageway 96.

Figure 10D:
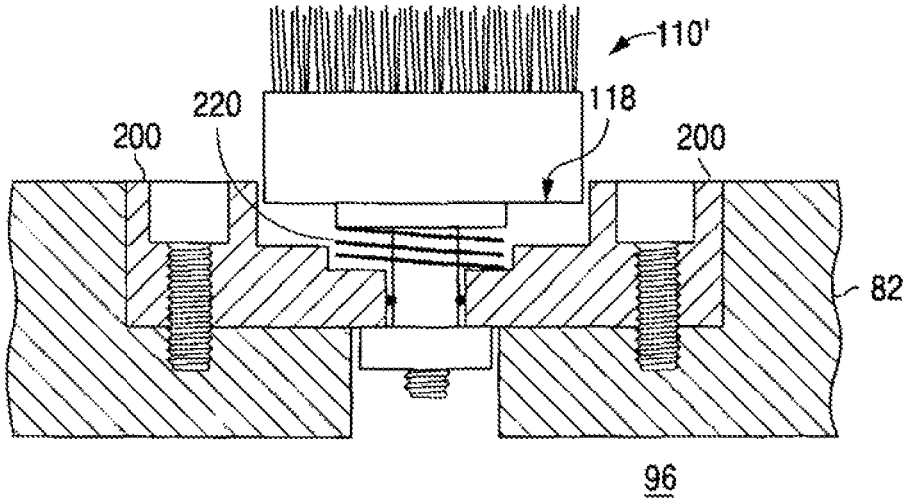

In some embodiments, as shown in FIG. 10D, the retractable brush assembly 110' may be biased to be in the extended position by a spring 220 disposed between the inserts 200 and the bottom, flat surface 118' of the holder portion of the brush assembly 110'. In this fashion, the brush assembly 110' may retract when it reaches a bend or turn in the well casing, thereby allowing the cleaning assembly tool 80 to pass the bend and reach the area of the well casing that requires cleaning.

Figure 11A:
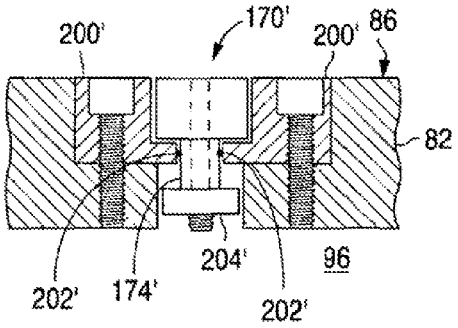
FIGS. 11A-11D are cross-sectional views of piston-type assemblies adapted to allow radial movement of a nozzle
Figure 11B:
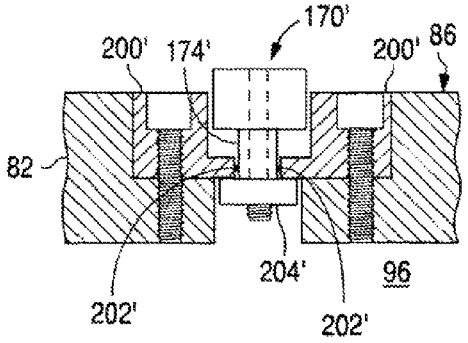
Figure 11C:
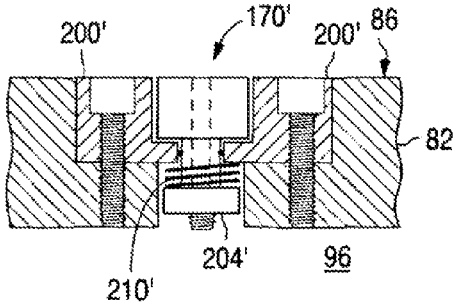

In some embodiments, as shown in FIGS. 11A-11D, nozzles 170' may be retractable or capable of piston-like movement. In operation, while the assembly 80 is being lowered to the desired production area that requires cleaning, each nozzle 170' is in a retracted position as shown in FIGS. 11A and 11C, thereby avoiding possible damage before the assembly 80 reaches the area to be cleaned. When cleaning fluid is introduced into the central fluid passageway 96, pressure from the fluid may force the nozzles 170' radially outward to an extended position (FIGS. 11B and 11D), away from the center of the tube 82, thereby bringing high pressure jets of cleaning fluid closer to the inner surface of the well casing to be cleaned.

Retraction may be accomplished using a piston-type assembly that includes inserts 200' that are bolted to the body of the tube 82. Sealing elements 202', such as O-rings, may be used between sliding surfaces of the inserts 200' and the stem 174' of the nozzle 170'.

The stem 174' may include a locking element 204' that limits the radially outward movement of the nozzle.

In other embodiments, as shown in FIG. 11C, the retractable nozzle 170' may be biased to be in the retracted position by a spring 210' disposed between the locking element 204' and the inserts 200'. In this fashion, the nozzle 170' remains in the retracted position until a threshold level of fluid pressure is present in the central fluid passageway 96.

Figure 11D:
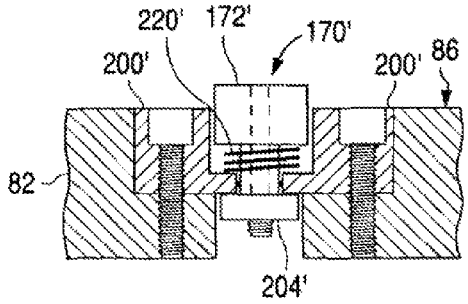

In some embodiments, as shown in FIG. 11D, the retractable nozzle 170' may be biased to be in the extended position by a spring 220' disposed between the inserts 200' and the bottom of the head portion 172' of the nozzle 170'. In this fashion, the brush assembly 110' may retract when it reaches a bend in the well casing, thereby allowing the cleaning assembly tool 80 to pass the bend and reach the area of the well casing that requires cleaning.

Figure 12:
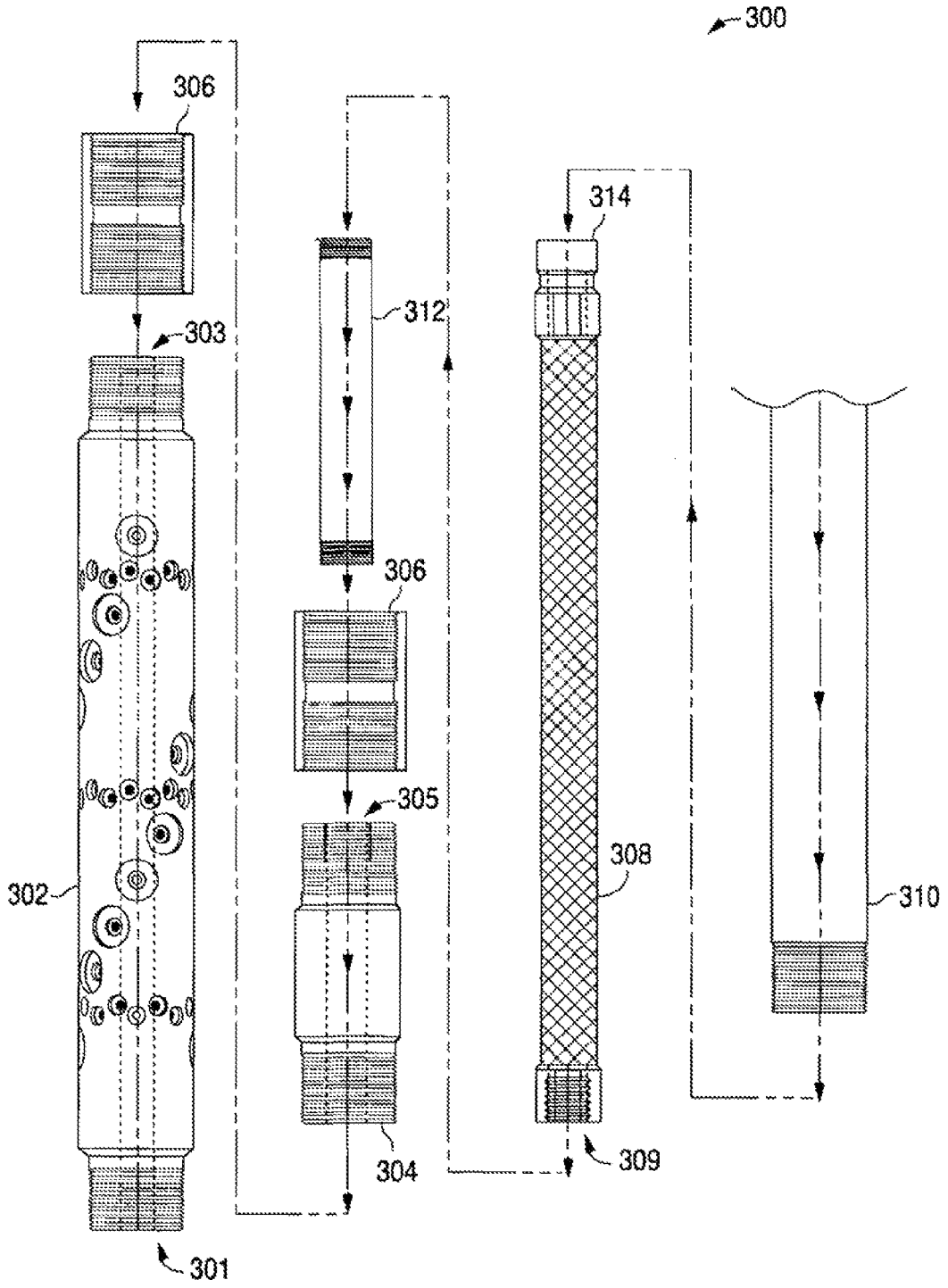
FIG. 12 is an side elevation view of a system for improving down hole operations, showing the system in a disassembled state.
Figure 13:
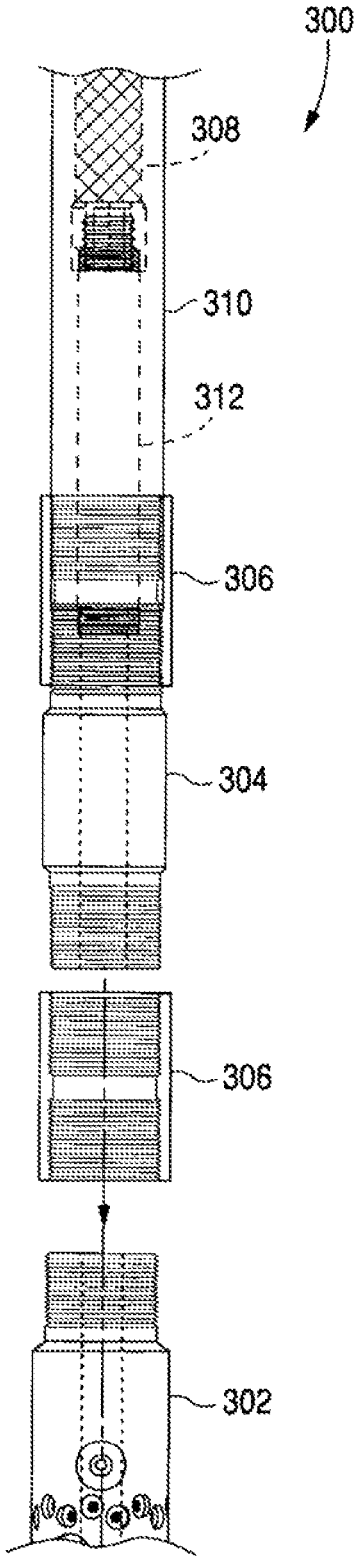
FIG. 13 is a side elevation view of the system of FIG. 12, showing the system in a partially assembled state with a scratcher tube removed from the rest of the system.

A system 300 for improving pumping operations in accordance with embodiments of the present invention is shown in FIGS. 12 and 13. FIG. 12 shows the system 300 disassembled, and FIG. 13 shows the system 300 partially assembled. The system 300 comprises a hollow scratcher tube 302 having a plurality of outlet holes for holding high pressure nozzles and a plurality of inset portions for holding brush assemblies. The scratcher tube 302 is externally threaded at a bottom end 301 to allow it to be connected to another tool, such as a scraper, or to allow it to be capped off with an end cap. The scratcher tube 302 is also externally threaded at an inlet end 303 to allow it to be connected to a base sub 304. A standard coupler 306 with internal threads at both ends may be used to connect the scratcher tube 302 to the base sub 304.

The base sub 302 is a hollow tube and includes external threads and internal threads at its inlet end 305. The external threads allow the base sub 304 to be connected to a working string 310. The working string 310 is a hollow tube which is used to lower the scratcher tube 302 to the region of a well casing that is to be cleaned and is used to deliver cleaning fluid to the scratcher tube. Another standard coupler 306 may be used to connect the inlet end 305 of the base sub 304 to the working string 310. The internal threads at the inlet end 305 of the base sub 304 allow the base sub 304 to be connected to a tubular filter 308. The tubular filter 308 is hollow includes cylindrical walls made of fine stainless steel mesh. Cleaning fluid delivered down the working string 310 passes through the mesh of the cylindrical walls and exits through an outlet end 309 which is in fluid communication with the internal fluid passageway of the scratcher tube 302. The outlet end 309, which is internally threaded, is connected to the inlet end 305 of the base sub 304. This connection may be accomplished using a stainless steel pipe 312 that is externally threaded at both ends. When assembled, as shown in FIG. 13, the filter 308 is located inside of the working string 310. The filter 308 is sized so that there is a gap or space between its cylindrical walls and the internal circumference of the working string 310. In this manner, cleaning fluid delivered down into the working string 310 may easily pass into the filter 308. The top end of the filter 308 may be covered by an end cap, or may be connected to another filter to allow for greater filtering capacity in order to support delivery of higher volumes of cleaning fluid to the scratcher tube 302.

In some embodiments, the system 300 may include a pressure valve disposed above the scratcher tube 302 and configured to limit or prevent delivery of fluid to the scratcher tube 302 unless a predetermined fluid pressure, referred to as an opening threshold pressure, is present in the working string 310. The pressure valve may include a valve element that is biased to a closed position by a spring that pushes the valve element at a force level that corresponds to the opening threshold pressure. In some embodiments, the pressure valve is located within the base sub 304. In some embodiments, the pressure valve is located within the pipe 312 between the base sub 304 and the filter 308. By controlling the fluid pressure in the working string 310, cleaning fluid may be prevented from flowing out of the scratcher tube 302 while the scratcher tube 302 is being lowered into the well casing before reaching the region to be cleaned. In this manner, the amount of cleaning fluid that is wasted can be reduced. Also, the quantity of cleaning fluid that enters the geological formation can also be minimized if desired.

In some embodiments, the system 300 may include a choke device that limits or prevents delivery of fluid to the scratcher tube 302 when the fluid pressure inside the working string 310 is excessive. In this way, damage to nozzles and any piston-type assemblies on the scratcher tube 302 due to a sudden pressure shock may be avoided.

As shown in FIG. 12, the outlet holes and inset portions on the scratcher tube 302 may be positioned at a distance from the threaded ends that is sufficient to allow holding and turning tools, such as tongs, to engage the scratcher tube and facilitate assembly. The distance may from one to three inches.

Figure 14:
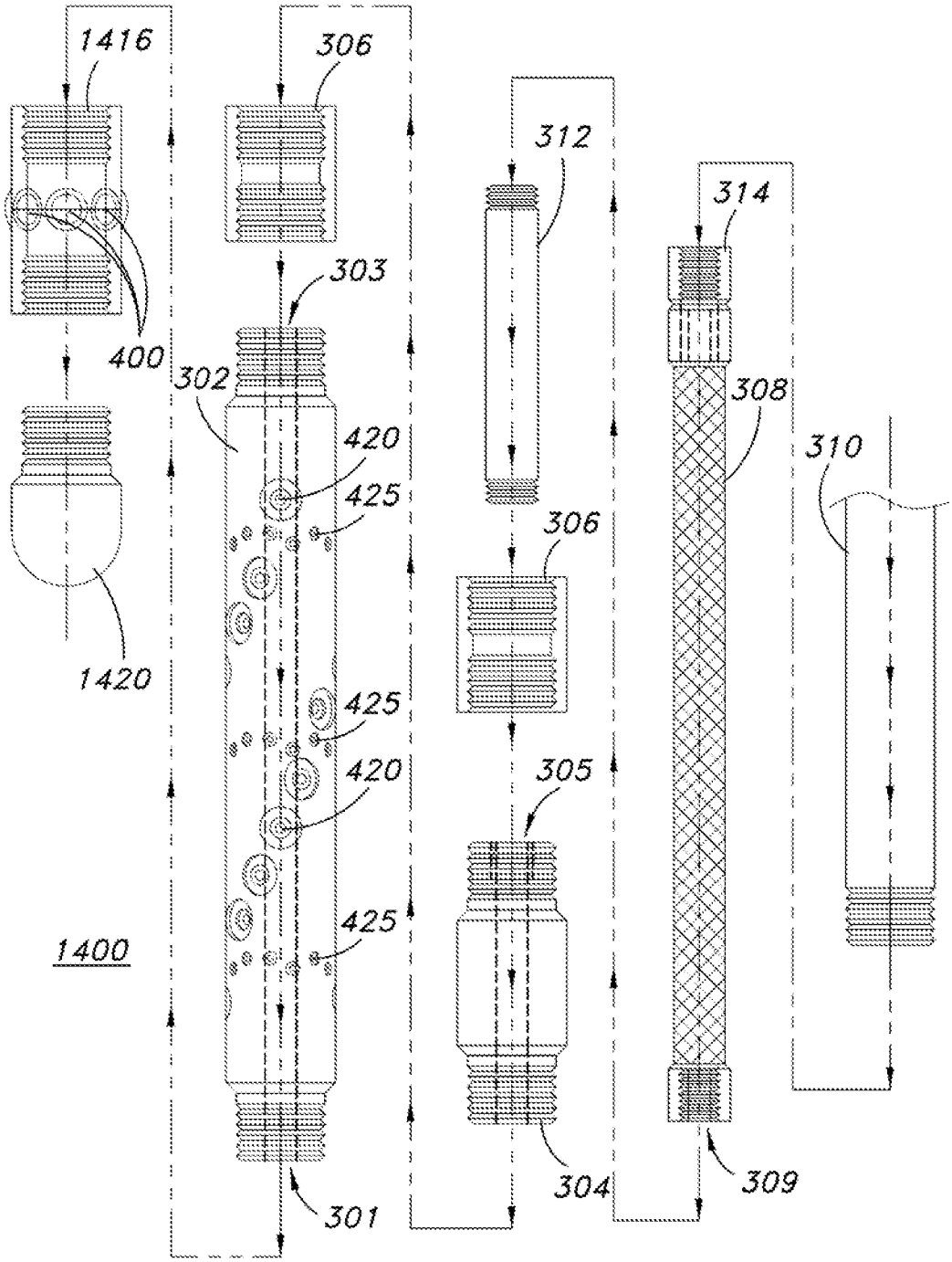
FIG. 14 illustrates an example of side elevation view of a system for improving down hole operations, showing the system in a disassembled state.
Figure 15:
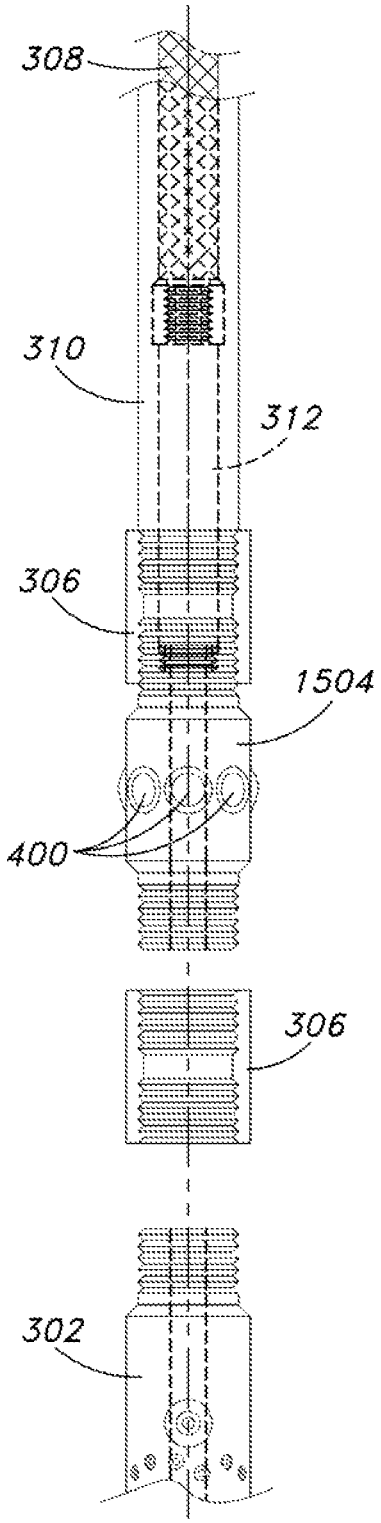
FIG. 15 illustrates an example of a side elevation view of the system of FIG. 14, showing the system in a partially assembled.

During the operation of system 300, significant damage can occur to the brush assemblies of scratcher tube 302. FIGS. 14 and 15 illustrate one or more examples of embodiments of a system 1400 for improving pumping operations. System 1400 can also be considered a system for improving pumping operations with improved protection for brush assemblies. FIG. 14 shows system 1400 disassembled, and FIG. 15 shows system 1400 partially assembled.

System 1400 can be considered similar to system 300 of FIGS. 12 and 13. For example, system 1400, like system 300, can comprise a scratcher tube 302, one or more couples 306, a base sub§, a stainless steel pipe 312, a tubular filter 308, an end cap, and a working string 310. In addition, system 1400 can comprise one or more skid assemblies 400. Furthermore, system 1400 can also comprise a guide piece 1416 with one or more skid assemblies 400.

Skid assemblies 400 can assist system 1400 when system 1400 is placed and operating within a well casing. For example, skid assemblies 400 can help maintain system 1400, and particular scratcher tube 302, maintain a position that is relatively centrally located within a well casing. In addition, skid assemblies 400 can assist in protecting brush assemblies from becoming damaged during the operation of system 1400.

As can be seen in FIG. 14, system 1400 comprises a scratcher tube 302. Scratcher tube can comprise inset portions 420 and outlet holes 425. As previously discussed, outlet holes 425 can be used for holding high pressure nozzles. Similarly, inset portions 420 can be used to hold brush assemblies. In addition, inset portions 420 can be used to hold skid assemblies 400. Skid assemblies 400 are described further with reference to FIG. 16.

With continued reference to FIG. 14, skid assemblies 400 can be used in any of the inset portions 420 on scratcher tube 302. In some examples, there are at least three skid assemblies 400 positioned within inset portions 420. If there are three skid assemblies 400 attached to scratcher tube 302, each of the skid assemblies 400 may be separated from each other by approximately 120 degrees radially as an example.

In other examples, there may be four skid assemblies 400 attached to scratcher tube 302. In such examples, each of the skid assemblies may be positioned approximately 90 degrees apart radially. For example, if there is a double helical pattern to the inset portions 420, as previously discussed, two skid assemblies 400 can be positioned 180 degrees apart radially from one another. In some examples, these two skid assemblies can be positioned at the same distance latitudinally on scratcher tube 302. In addition, the two other skid assemblies 400 can also be positioned 180 degrees radially from one another and at the same or different distance latitudinally on scratcher tube 302. Furthermore, the second set of two skid assemblies can be positioned with a 90 degree offset radially from the first set of two skid assemblies. In such a setting, each skid assembly will be separated from the nearest radial skid assembly by approximately 90 degrees. It should be noted that less than three or more that four skid assemblies 400 can be positioned on scratcher tube 302. In addition, skid assemblies can be positioned at any radially separation that is desired.

Figure 17:
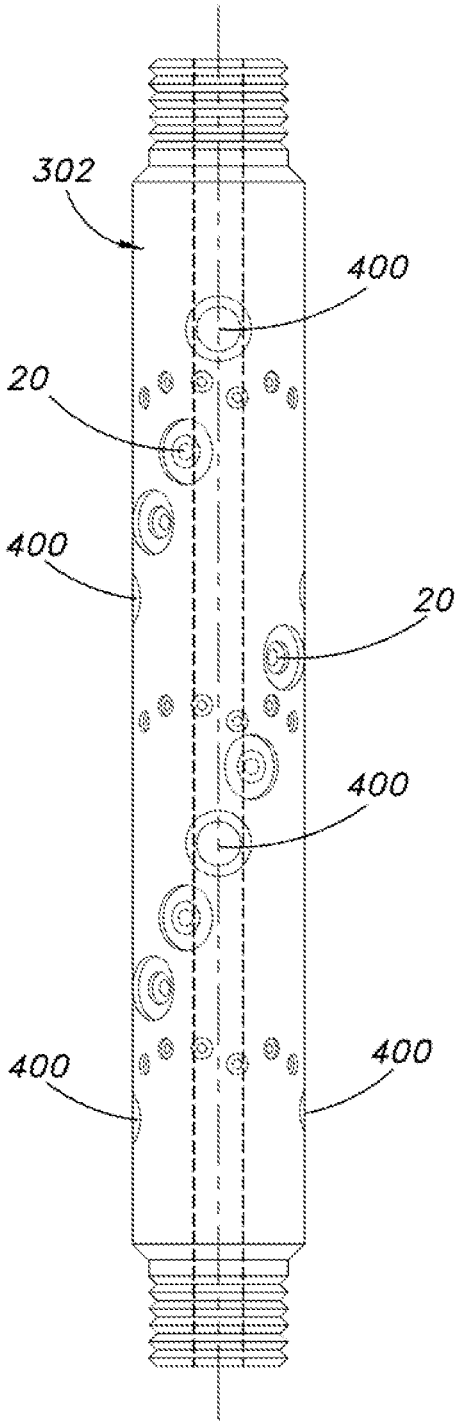
FIG. 17 illustrates an example of a hollow scratcher tube according.

FIG. 17 illustrates an example of a scratcher tube 300 removably coupled to brush assemblies 20 and skid assemblies 400 via inset portions of the scratcher tube 302, according to an embodiment. As can be seen in FIG. 17, there is a double helical pattern to the inset portions, which either comprise a brush assembly 20 or a skid assembly 400. In the example of FIG. 17, each skid assembly 400 is separated from the nearest radial skid assembly by approximately 90 degrees. In addition, each skid assembly 40 is radially separated from the nearest latitudinal skid assembly by 180 degrees.

In addition to having skid assemblies on scratcher tube 302, system 1400 may comprise skid assemblies 400 on guide piece 1416. Guide piece 1416 can comprise a hollow tube and can include external threads and internal threads that will allow the guide piece 1416 to couple with scratcher tube 302 and end cap 1420. Any number of skid assemblies 400 can be positioned on guide piece 1416. In addition, skid assemblies 400 on guide piece 1416 can be larger or smaller than those placed on scratcher tube 302. In some examples, skid assemblies 400 coupled to guide piece 1416 are the same size as skid assemblies 400 coupled to scratcher tube 302. In some example, skid assemblies 400 are uniformly radially positioned around guide piece 1416.

FIG. 20 illustrates an example of a cross-sectional view of guide piece 1416 with four skid assemblies 400 while system 1400 is in a well casing 2050. As can be seen in FIG. 20, the four skid assemblies 400 extend outwardly from guide piece 1416. This configuration helps minimize the displacement of system 1400 when in a well casing. As the guide piece 1416 moves laterally towards the walls of the well casing 2050, the skid assemblies 400 will collide with the wall, therefore minimizing the amount of lateral movement of system 1400 is well casing 2050.

Similarly, and with reference to FIG. 15, system 1400 may comprise skid assemblies 400 on base sub 1504. Once again any number of skid assemblies 400 can be positioned on base sub 1504. In addition, skid assemblies 400 on base sub 1504 can be larger or smaller than those placed on scratcher tube 302 and/or end cap 1416. In some examples, skid assemblies 400 coupled to base sub 1504 are the same size as skid assemblies 400 coupled to scratcher tube 302 and/or end cap 1416. In some example, skid assemblies 400 are uniformly radially positioned around base sub 1504.

It should be noted that system 1400 can include skid assemblies 400 on any combinations of the end cap 1416, the scratcher tube 302, and the sub base 1504. For example, only one of the end cap 1416, the scratcher tube 302, or the sub base 1504 can comprise skid assemblies 400. In other examples any two of the end cap 1416, the scratcher tube 302, and the sub base 1504 can comprise skid assemblies. In yet another example, all three of the end cap 1416, the scratcher tube 302, and the sub base 1504 can comprise skid assemblies 400.

Figure 16:
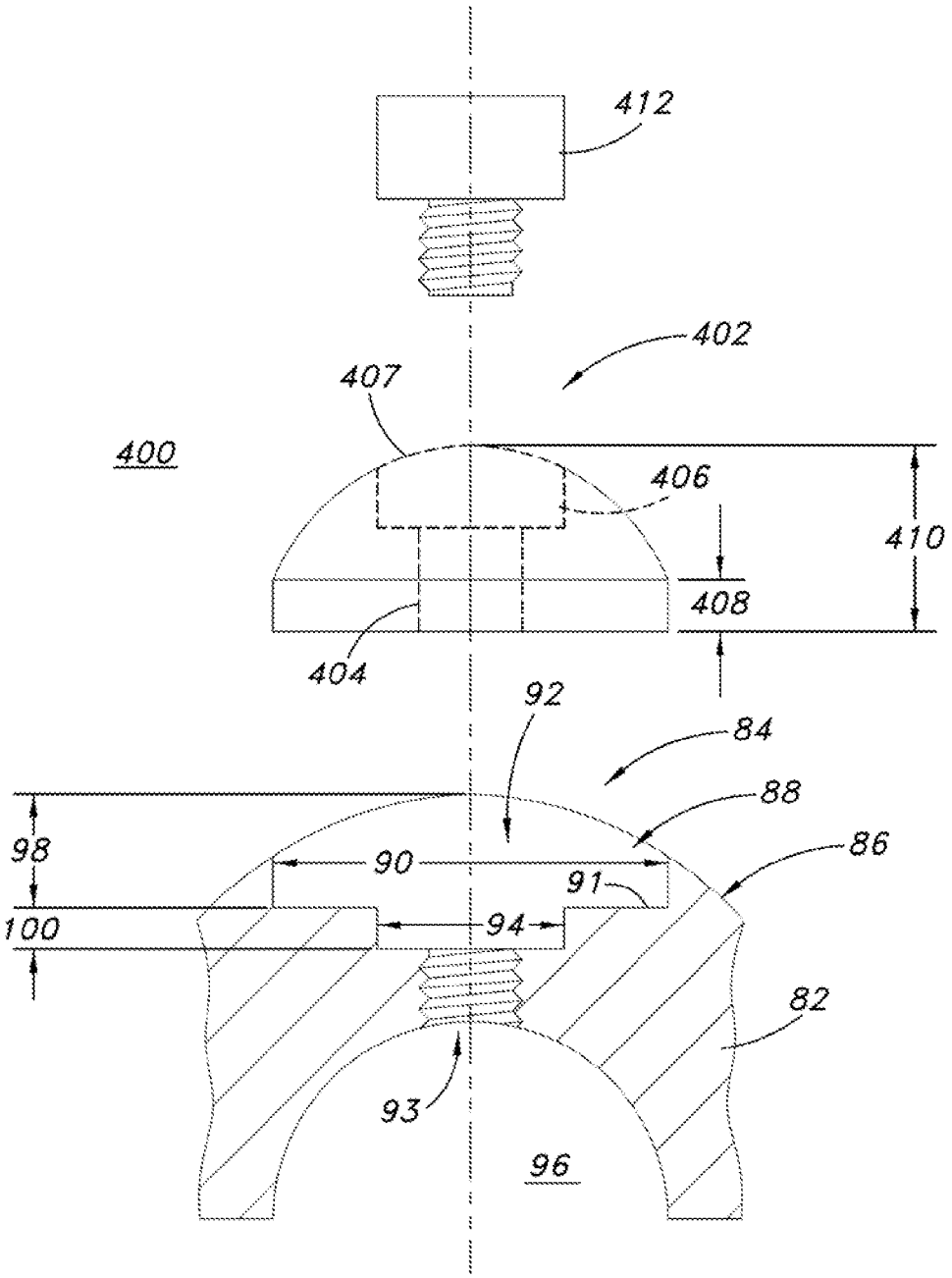
FIG. 16 illustrates an example of a skid assembly.

In some embodiments, as shown in FIG. 16, the skid assembly 400 comprises a skid 402 and a fastening bolt 412 that attaches to inset portions 84 on the scratcher tube 82. The skid 402 can comprises a semi-spherical body 410 connected to a cylindrical base 408, which sits below the circumferential surface 86 of the hollow tube. The skid 402 can comprise two cylindrical cavities (a lower skid cavity 404 and an upper skid cavity 406) through the middle of the skid to accommodate the fastening bolt 412. It should be noted that the body 410 can comprise shapes other than semi-spherical. For example, the body 410 can be a portion of a sphere that is less than 50%. Other examples for the body shape can include: conical, cylindrical, pyramid, and the like. In addition, the skid body can comprise other shapes not specifically mentioned herein.

Figure 18:
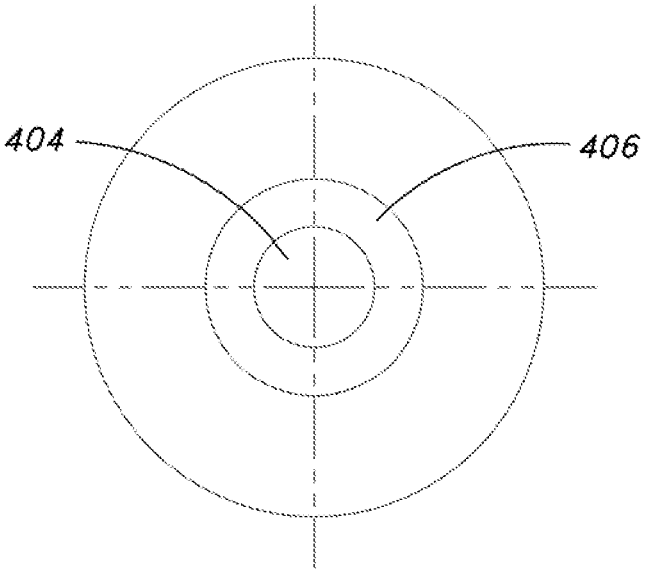
FIG. 18 illustrates an example of a cross sectional view of a skid assembly.
Figure 19:
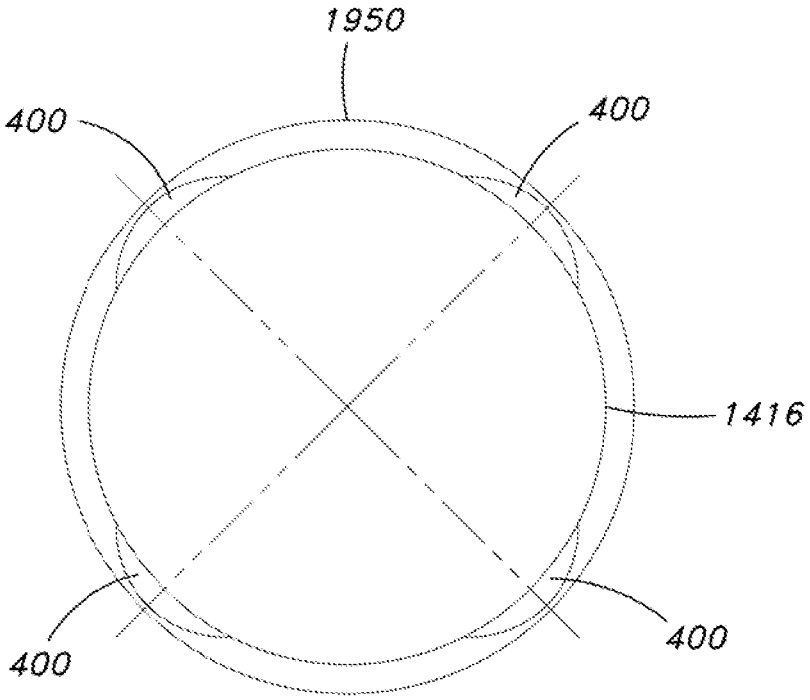
FIG. 19 illustrates an example of a cross sectional view of a guide piece.

FIG. 18 shows an example of a top view of skid 402 according to one embodiment. As illustrated in the example of FIG. 18, lower skid cavity 404 can have a smaller radius than upper skid cavity 406.

In some embodiments the lower skid cavity 404 can have radius that is equal to or slightly larger than the radius of the thread of the fastening bolt 412. In the same or other embodiments the upper skid cavity 406 can have a radius that is equal to or slightly larger than the radius of the head of the fastening bolt 412. In some embodiments, the fastening bolt 412 is a 5/16"-18 hex head bolt and the threaded hole 93 is tapped to receive the 5/16"-18 thread of the bolt. The skid assembly threads into the inset portions 84, which may comprise: a main body in the form of a hollow tube 82 has a recess or inset portion 84 that is formed into the outer circumferential surface 86 of the hollow tube. The inset portion 84 includes a first counter bore 88 having a first diameter 90. The bottom surface 91 at the base of the first counter bore 88 provides a flat contact surface area that frictionally engages the skid 402.

In some embodiments the skid 402 comprises steel or aluminum. As an example, skid 402 can comprise stainless steel. In some embodiments the skid assembly 400 protrudes from the scratcher tube 82 less than the brush assemblies 110, but protrudes more than the holder portion 112 of the brush assembly 110. As an example, the brush assemblies can extend from approximately 0.100 to approximately 0.135 inches past the edge of well casing walls; and the skid assemblies can extend from approximately 0.100 to approximately 0.135 inches short of the same well casing walls. It should be noted that the brush assemblies can extend less than or more than 0.100 to 0.135 inches past the well casing. For example, the brush assemblies can extend from approximately 0.001 to approximately 0.135 inches past the well casing or from approximately 0.135 to approximately 0.25 inches past the well casing. Likewise, the skid assemblies can extend less than or more than 0.100 to 0.135 inches short of the well casing walls. For example, the skid assemblies can extend from approximately 0.001 to approximately 0.135 inches short of the well casing or from approximately 0.135 to approximately 0.25 inches short of the well casing. In other embodiments the brush assemblies can extend approximately 0.125 inches past the well casing and the skid assemblies can extend to approximately 0.125 inches short of the well casing.

With continued reference to FIG. 16, the creation of the upper skid plat cavity 406 can leave an open area at the top of skid 402, which is designated by the dotted line 407. This can create a sharp edge as seen in FIG. 16. In some embodiments, this sharp edge can be deburred. In other embodiments, a cap can be placed over the upper skid plat cavity 406. This cap can follow the path designated by dotted line 407. In yet other embodiments, a customized fastening bolt 412 can be used, which, when fully assembled, would have a top edge that follows the path designated by dotted line 407. In yet other embodiments, the sharp edges remain.

The skid assemblies 400 can be coupled to the guide piece 1416 and the base sub 1504 as described above in relation to scratcher tube 302. In addition, this configuration allows additional tools to be used instead of skid assemblies and/or brush assemblies. For example, it may be desirable to couple a scraper assembly to the inlet portions of the guide piece. The scraper assembly would function to scrape the walls of a well casing while system 1400 is in operation. In such examples, the scraper assemblies would be coupled to the guide piece in a fashion that is similar to how the skid assemblies and/or brush assemblies are coupled to the scratcher tube. Furthermore, in such an embodiment, the radius from the center of the guide piece to the outer edges of the scrapper assemblies can be nearly the length as the radius of the well casing.

In some embodiments, system 1400 comprises a system that can be used in a number of different environments. For example, system 1400 can be used in a number of different sized casings. As an example, guide piece 1416 can be used for operations of various sized well casings. Guide piece 1416 can be coupled to the other elements of system 1400 as described above. The same sized guide piece can be configured to attach to system 1400 using a universal sized threading. In addition, different sized skid assemblies 400 can be coupled to the guide piece 1416. For larger casings, a larger skid assembly can be used, thereby causing the radius from the center of the guide piece the outer edge of the skid assembly to increase and be closer to the walls of the well casing.

In some embodiments, system 1400 can be used in well casings that bend. The configuration of system 1400, with the addition of skid assemblies 400 allow system 1400 to maneuver turns in the casing more easily.

While particular embodiments of the invention and variations thereof have been described in detail, other modifications and methods will be apparent to those of skill in the art. Accordingly, it should be understood that various applications, modifications, and substitutions may be made of equivalents without departing from the spirit of the invention or the scope of the claims. Various terms have been used in the description to convey an understanding of the invention; it will be understood that the meaning of these various terms extends to common linguistic or grammatical variations or forms thereof. Further, it should be understood that the invention is not limited to the embodiments that have been set forth for purposes of exemplification, but is to be defined only by a fair reading of claims that will be appended, including the full range of equivalency to which each element thereof is entitled.

While several particular forms of the invention have been illustrated and described, it will also be apparent that various modifications can be made without departing from the scope of the invention. It is also contemplated that various combinations or subcombinations of the specific features and aspects of the disclosed embodiments can be combined with or substituted for one another in order to form varying modes of the invention. Accordingly, it is not intended that the invention be limited, except as by the appended claims.

What is claimed is:

1. A device for improving pumping operations through a casing or lining, the device comprising:

a hollow tube including a tube wall having an outer circumferential surface and an inner circumferential surface, the inner circumferential surface defining a fluid passageway;

brushes on the outer circumferential surface;

skids on the outer circumferential surface; and outlet holes formed through the tube wall.

2. The device of claim 1, wherein the brushes and the skid are arranged along a double helical pattern on the outer circumferential surface.

3. The device of claim 1, wherein the outlet holes are arranged in a plurality of groups, each group forming a circular pattern around the outer circumferential opening.

4. The device of claim 1, wherein the brushes include a plurality of brush assemblies, and at least one of the brush assemblies is removably attached to the tube wall.

5. The device of claim 1, wherein at least one of the skids is removably attached to the tube wall.

6. The device of claim 1, wherein the brushes and skids are seated in a recess formed into the outer circumferential surface of the tube wall.

7. The device of claim 1, wherein the brushes and skids are interchangeable.

8. A system for improving pumping operations, comprising:

one or more brushes;

one or more skids;

one or more outlet holes;

a working string; and a hollow tube wherein:

the one or more brushes are coupled to the hollow tube; and the hollow tube comprises at least a portion of the one or more outlet holes.

9. The system of claim 8, wherein the at least a portion of the one or more skids are coupled to the hollow tube.

10. The system of claim 8, further comprising a guide piece.

11. The system of claim 10, wherein at least a portion of the one or more skids are coupled to the guide piece.

12. The system of claim 11, wherein a portion of the one or more skids are coupled to the hollow tube.

13. The system of claim 11, wherein the guide piece is configured to be coupled to skids of multiple sizes.

14. The system of claim 13, wherein the guide piece is capable of being used in a plurality of well casings of different radii.

15. An apparatus for protecting brushes on a device for improving pumping operations, comprising:

a base;

a body;

and a fastening bolt;

wherein:

the base is cylindrical; and the body comprises a shape that is a portion of a sphere.

16. The apparatus of claim 15, further comprising:

an upper cavity and a lower cavity;

wherein the upper cavity has a radius that is greater that the lower cavity.

17. The apparatus of claim 15, wherein:

the fastening bolt is configured to be coupled to a hollow tube for use in improving pumping operations.

* * * * *